United States Patent [19]

Groenendaal

[11] Patent Number: 4,863,341

[45] Date of Patent: Sep. 5, 1989

[54] TURBINE HAVING SEMI-ISOLATED INLET

[75] Inventor: John C. Groenendaal, Winter Springs, Fla.

[73] Assignee: Westinghouse Electric Corp., Pittsburgh, Pa.

[21] Appl. No.: 194,650

[22] Filed: May 13, 1988

[51] Int. Cl.[4] ..... F01D 3/02

[52] U.S. Cl. ..... 415/103; 415/134; 415/177

[58] Field of Search ..... 415/134, 136, 137, 138, 415/139, 219 R, 103, 177

[56] References Cited

U.S. PATENT DOCUMENTS

| | | | |
|---|---|---|---|
| 3,018,736 | 1/1962 | Clay | 415/219 R |
| 3,408,045 | 10/1968 | Hart | 415/138 |
| 3,529,901 | 9/1970 | Hart et al. | 415/138 |
| 3,594,095 | 7/1971 | Trassel et al. | 415/134 |
| 4,232,993 | 11/1980 | Ikeda et al. | 415/134 |
| 4,764,084 | 8/1988 | Parker et al. | 415/139 |

FOREIGN PATENT DOCUMENTS

| | | | |
|---|---|---|---|
| 43202 | 3/1986 | Japan | 415/134 |

*Primary Examiner*—Robert E. Garrett
*Assistant Examiner*—John T. Kwon

[57] ABSTRACT

A turbine having structure for reducing thermal deformation caused by thermally created loads directed parallel to the axis of rotation of the rotor, which structure includes a stator assembly, positioned within a casing and about said rotor, wherein the casing has an inlet defined by sidewalls, the stator assembly having an inlet for directing a flow of steam, wherein the inlet is defined by first blade rings connected to the casing sidewalls and having a stationary annular row of blades connected to each of the blade rings and operatively positioned in relation to the rotor blades for directing a flow of steam onto the rotor blades and having a number of ribs disposed within said stator assembly about said rotor, wherein the ends of said ribs are spaced away from the sidewalls and the first blade rings. The sidewalls of the casing can also be disposed substantially perpendicular to the axis of rotation so that thermally created loads caused by heat transferred from said flow of steam to the sidewalls are directed primarily perpendicular to the axis of rotation.

18 Claims, 5 Drawing Sheets

TURBINE HAVING SEMI-ISOLATED INLET

FIELD OF THE INVENTION

The present invention relates to the field of turbines, and more particularly, to the structure of steam turbines in the inlet area for minimizing thermal distortion effects.

BACKGROUND OF THE INVENTION

The provision of steam to a turbine is typically accompanied by the transfer of heat between the steam and those parts of the turbine coming into contact with the steam. This heat transfer has the tendency to create thermal distortion in various components of the turbine due primarily to thermal expansion and/or contraction occurring as a result of the heat transfer. Any resulting deformation of such turbine parts can be of two types: elastic which is recoverable upon release of the distortion, and plastic which is permanent. In certain application plastic deformation can be significant enough to permanently damage stay bars mounted within the inlet chamber or the horizontal joint flange of the turbine inner casings, requiring costly repairs and replacement of damaged parts.

Thermal distortion could also become significant enough to cause an ovalized deformation of the ends of the turbine inner casing. Such ovalized deformation can cause portions of the inner casing which are in close proximity to the rotor blades to move away from such blades resulting in increased clearance and attendant leakage. A far more serious consequence of such ovalized deformation is where portions of the inner casing move towards the rotor blades. If such movement is significant, the rotor blades will rub the surface of the inner casing causing damage and degradation of efficiency.

It is therefore desirable to minimize the effects of thermal deformation in order to preserve the efficiency as well as the proper alignment of the turbine.

The problems caused by thermal deformation of turbine components are a particularly important consideration in the design of low pressure steam turbines. In low pressure steam turbines there is a significant difference in the steam temperature at the turbine inlet and at the turbine exhaust or annulus. For example, it has been determined that steam entering a low pressure turbine inlet can have a temperature of approximately 700° F., whereas the temperature of the steam as it crosses the last row of blades can be approximately 100° F. The thermal loading resulting from such a temperature drop can cause the above described effects.

Consider briefly a presently available low pressure steam turbine such as that shown in FIG. 1. Steam from a source (not shown) is provided to turbine 10 through conduit 12 which is attached to the outer surface of outer casing 14. Steam passes through an opening in the outer casing, through an opening in an inner casing 16, to an inlet chamber 18, which chamber is formed in the inner casing. A rotor 20 is mounted in bearings 22 to rotate about an axis of rotation "A". A number of annular rows of blades 24 are disposed about the periphery of rotor 20. A number of stationary annular rows of blades 26 are operatively positioned in relation to rotor blades 24 for directing the steam onto rotor blades 24. Stationary blades 26 are positioned through their attachment to various blade rings which in turn are attached to walls 30 of inner casing 16. Inlet blade rings **29*a* and 29*b* are positioned such that an opening 31 is formed therebetween for the passage of the flow of steam. Inner casing 16 is aligned to outer casing 14 by fitted dowl assemblies 32**.

Inlet chamber 18 is shown to include sidewalls 34 which are oriented at an angle to the axis of rotation "A". Sidewalls 34 are attached at one end to walls 30 and at the other end to inlet rings **29*a* and 29*b*. A number of stay bars 36 (only one is shown) are provided between inlet rings 29*a* and 29*b*. A number of ribs 38*a* and 38*b* are positioned within inner casing 16 about rotor 20, such that the ends of each rib is in contact with walls 30 and inlet rings 29*a* and 29*b***.

In operation, a flow of steam is supplied to turbine 10 through conduit 12. The steam passes through outer and inner casings 14 and 16 to inlet chamber 18. Inlet chamber 18 directs the flow of steam to a rotor midpoint where the steam expands axially through alternating annular rows of stationary and rotor blades causing rotor rotation. After crossing the last row of blades the flow of steam is directed through exhaust 39 where it may be recycled.

SUMMARY OF THE INVENTION

It is an object of the invention to provide a turbine in which the effects of thermal distortion have been minimized.

It is another object of the invention to provide a turbine in which efficiency and alignment are maintained relatively stable.

It is another object of the invention to provide a turbine in which ovalized deformation has been minimized.

It is a further object of the invention to provide a turbine in which stay bar and inner casing horizontal joint flange deformation are controlled to provide long life.

It is a further object of the invention to provide a turbine in which plastic deformation of the stay bar and inner casing horizontal joint flange deformation is prevented.

It is a further object of the invention to provide a turbine in which the sidewalls of the inlet chamber are oriented substantially perpendicular to the rotor axis of rotation.

It is still a further object of the invention to provide a turbine in which the inner casing ribs are spaced away from the inlet sidewalls or the inlet blade rings.

These and other objects are achieved in a turbine having structure for reducing thermal deformation caused by thermally created loads directed parallel to the axis of rotation of the rotor, which structure includes an inner casing having an inlet for directing a flow of steam, wherein the inlet has sidewalls and a stator assembly, positioned within the casing and about said rotor, having an inlet for directing a flow of steam, wherein the inlet is defined by first blade rings connected to the sidewalls and a number of ribs disposed within said stator assembly about said rotor, wherein the ends of said ribs are spaced away from the sidewalls and the first blade rings. The sidewalls may also be disposed substantially perpendicular to the axis of rotation so that thermally created loads caused by heat transferred from said flow of steam to the sidewalls act in a primarily radial direction, i.e. perpendicular to the axis of rotation.

These and other objects and advantages of the invention will become more apparent from the following detailed description when taken in conjunction with the following drawings.

DETAILED DESCRIPTION OF THE PREFERRED EMBODIMENTS

Figure 2:
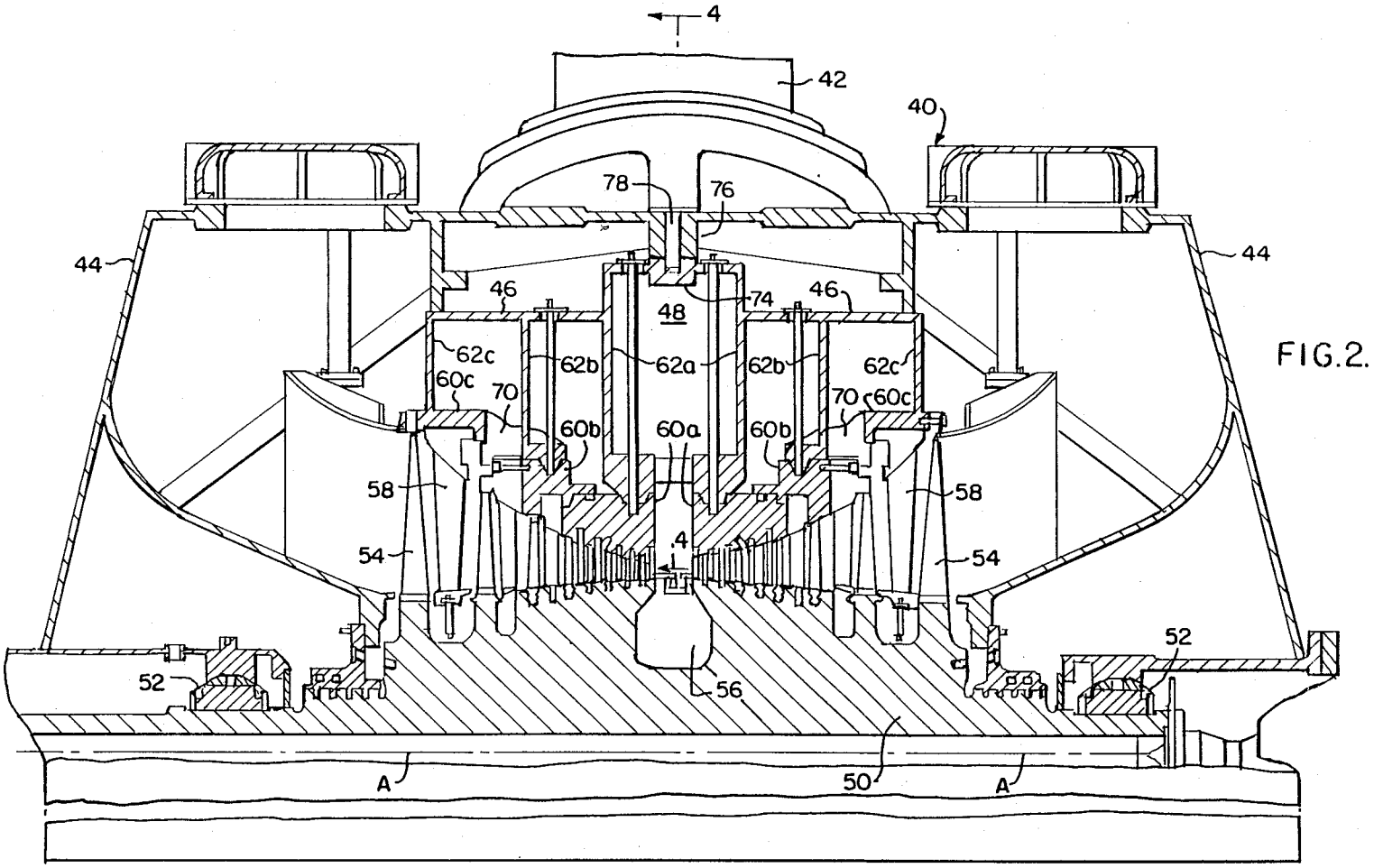
FIG. 2 is a partial section view of a low pressure steam turbine constructed in accordance with the present invention.

A new and novel inner casing for use in a low pressure steam turbine constructed in accordance with the principles of the present invention is depicted in FIG. 2. The low pressure steam turbine is generally referred to as 40. Steam from a source (not shown) is supplied to turbine 40 through conduit 42 which passes through an opening in outer casing 44. The flow of steam thereafter passes through an opening (Discussed in greater detail in reference to FIG. 4) in the inner casing 46, to an inlet chamber 48. Outer casing 44 and inner casing 46 are divided into upper and lower halves which are joined together in a known manner along central horizontal planes, the so-called horizontal joint flange (Shown in greater detail in FIG. 5).

A rotor 50 is mounted in bearings 52 to rotate about an axis of rotation "A". A number of annular rows of radially extending blades 54 are disposed about the periphery of rotor 50. The rows of blades 54 are axially spaced on either side of a rotor midpoint 56. Blades 54 contained in each row are of substantially uniform blade length for a given row. Blade length increases for each row the further that row is axially disposed away from rotor midpoint 56.

A stator or stationary assembly is provided about rotor 50 and is shown to include a number of stationary annular rows of blades 58 which are operatively positioned in relation to rotor blades 54 for directing the flow of steam onto rotor blades 54. Stationary blades 58 are positioned through their attachment to a number of rings **60*a* and 60*b* and blade ring 60*c* which in turn are attached to respective walls 62*a*, 62*b* and 62*c* of inner casing 46 on either side of midpoint 56. In the embodiment shown in FIG. 4, rings 60*a* and 60*b* are attached to walls 62*a* and 62*b* by any suitable means and are aligned by dowels 64*a* and 64*b***, respectively.

Although not shown, it will be understood that the stationary assembly is divided into generally identical upper and lower halves, which are attached to the upper and lower halves of the inner casing. The attachment of the rings **60*a* on either side of rotor midpoint 56 is such that an opening or inlet 65 is formed for directing the flow of steam, shown in FIG. 3. Rings 60*b* and 60*c* are shown to be axially spaced from ring 60*a* along a line or in a direction parallel to the axis of rotation "A" and away from rotor midpoint 56. A seal 68 of any appropriate type is provided in the space between rings 60*a* and 60*b***.

In order to prevent the flow of steam from passing between the first row of stationary blades and the rotor, a sealing mechanism 69 is provided between threse rows of blades. While the sealing mechanism can be of any design, it should be constructed such that axial forces generated by thermal loading are not transferred between the first rows of stationary blades.

Ribs 70 are positioned between walls **62*b* and rings 60*c* and are held in place by any suitable method. It will be noted that ribs 70 do not extend to or make contact with blade rings 60*a* or walls 62*a* but rather are spaced from such components. A stiffening gusset 72 is provided on wall 62*b*. Since the inlet chamber is no longer in contact with ribs 70, as were ribs 38*a* and 38*b* shown in FIG. 1, and since the inlet chamber is still connected with inner casing 46**, the inlet can be said to be semi-isolated.

Inner casing 46 is attached at various points to outer casing 44 and is maintained in a concentric spaced relationship with outer casing 44 by outwardly and inwardly extending peripheral bosses 74 and 76 with fitted dowels 78 or by inner casing support feet (not shown).

Figure 3:
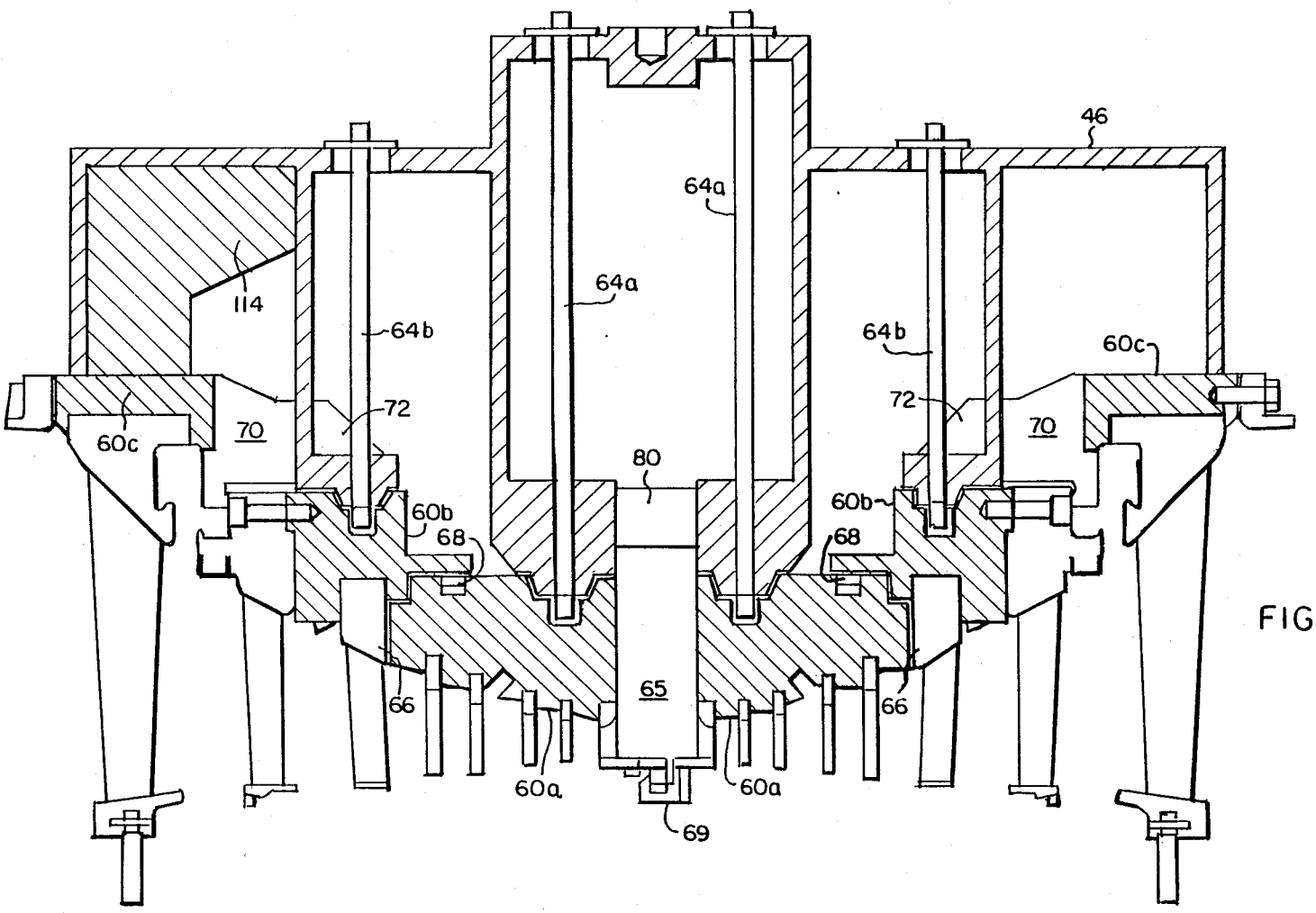
FIG. 3 is an enlarged view of a portion of FIG. 2, wherein the rotor and rotor asembly have been removed.
Figure 4:
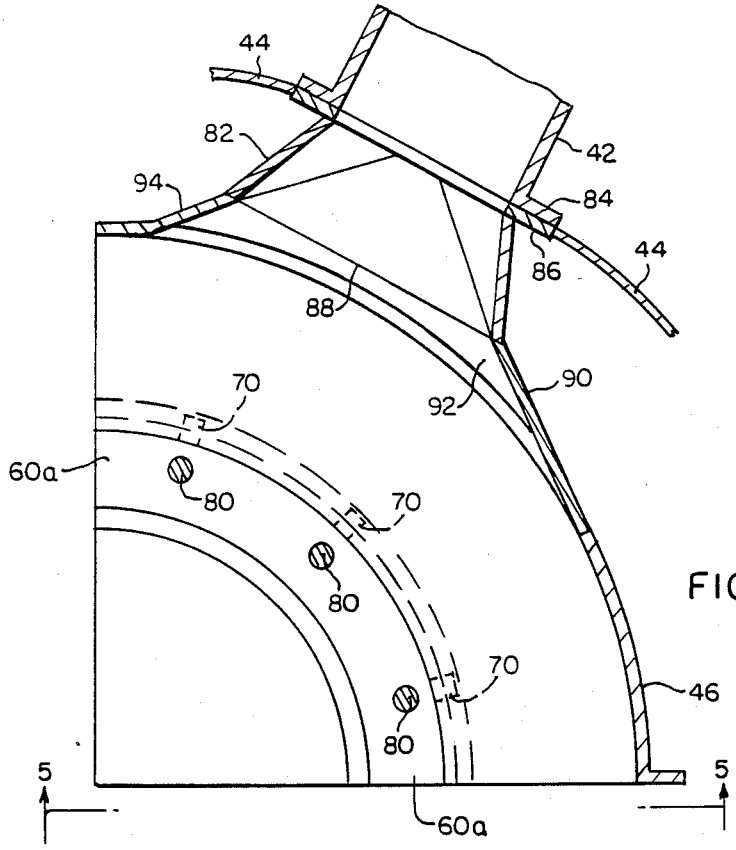
FIG. 4 is a section view taken along the line 4—4 in FIG. 2, wherein the stationary blades have been removed.

Inlet chamber 48 is shown to include sidewalls, i.e. walls **62*a*, which are disposed substantially perpendicular or radial to axis of rotation "A" so that thermal expansion caused by heat transferred from the flow of steam to sidewalls is directed primarily perpendicular to the axis of rotation. Consequently, any forces generated by such expansion, or contraction, will have a direction which is substantially radial. Referring to FIG. 3 and 4, a number of stay bars 80 are provided between rings 60*a***.

Figure 6:
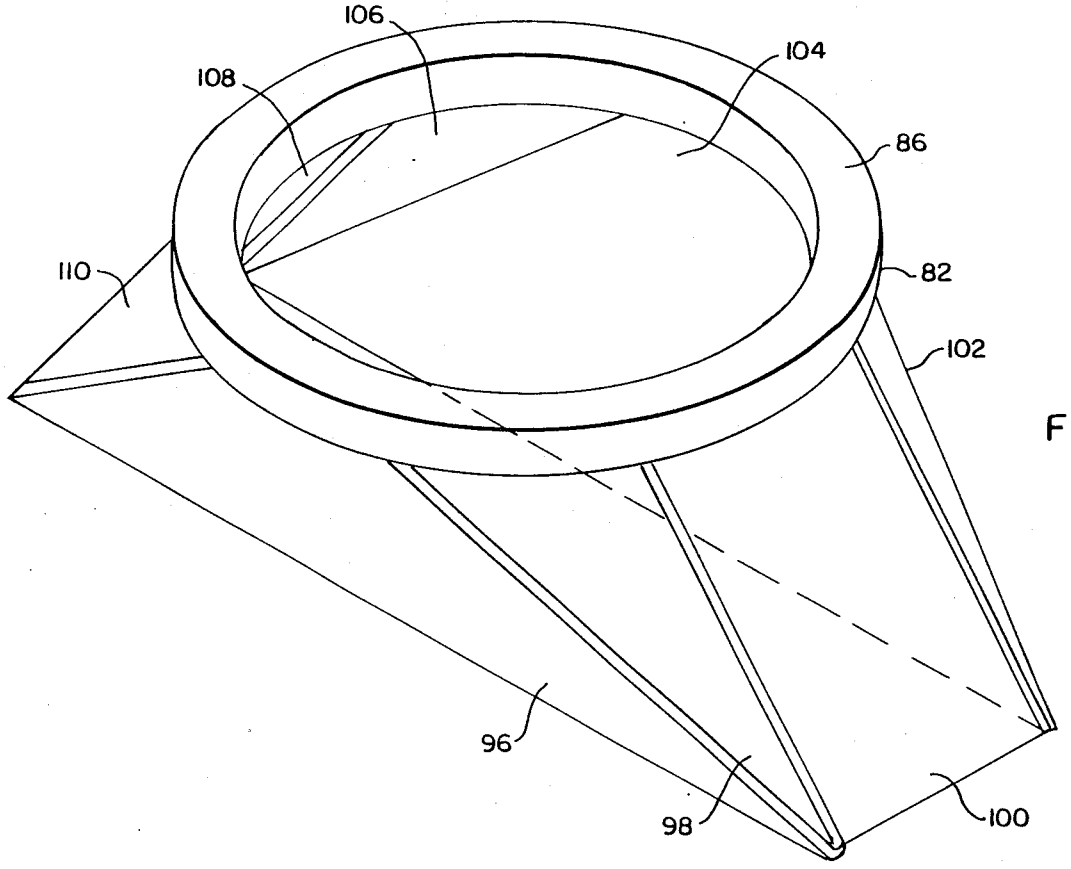
FIG. 6 is a perspective view of the transition structure positioned between the inner casing and the steam conduit.

A transition member 82, shown in FIGS. 4 and 6, is connected at a first end to conduit 42, the first end having an inner diameter equal to the inner diameter of conduit 42. Such connection is achieved by joining flange 84, formed at the end of conduit 42, to collar 86 on transition member 82 by any means suitable to create a fluid-tight seal therebetween. Although not shown, it should be understood that a flexible expansion diaphragm is provided between collar 86 and casing 44.

Transition member 82 is connected at its opposite end to inlet 48, the second end having a rectangular opening to match the size of the inner casing opening 88. As shown in FIG. 4, opening 84 is formed by walls 90, 92 and 94 which are attached to inner casing 46 by any means suitable to maintain a fluid-tight connection. Walls 90, 92 and 94 serve to interconnect transition member 82 with inlet 48.

As shown in FIG. 6, transition member 82 is made from a number of generally flat or planar pieces 96, 98, 100, 102, 104, 106, 108, and 110 which are shaped to provide a rectangular opening of a given dimension at one end and a circular opening of a given dimension at the other end. Pieces 96–100 can be joined together in any manner so long as a fluid-tight connection is established. Transition member 82 serves to provide a sealed fluid path between conduit 42 and opening 88.

Consider now turbine 40 during operation as shown in FIG. 2. A flow of steam is supplied to turbine 40 through conduit 42. The flow of steam passes through outer casing 44 and transition member 82 into semi-isolated inlet chamber 48 in inner casing 46. Inlet chamber 48 directs the flow of steam through the stator assembly inlet 65 to rotor midpoint 56 whereupon the steam expands axially through alternating annular rows of stationary and rotor blades causing rotor rotation. After crossing the last row of blades the flow of steam is directed through exhaust 88 whereupon it may be recycled.

While the flow of steam is in contact with various components of turbine 40 a significant amount of heat transfer takes place. This heat transfer generates thermal loads which act on the various components. It has been found that the axial forces, created as a result of such thermal loading, primarily contribute to stay bar damage as well as ovalized deformation. Prior inner casing inlet sidewall construction, such as walls 34 shown in FIG. 1, were oriented at an angle in relation to the axis of rotation. When such walls were thermally loaded, forces were produced which had components directed both radially and axially with respect to the axis of rotation. By providing sidewalls as shown in FIG. 2, for inlet 48, which are perpendicular to the axis of rotation these axial forces have been removed. Additionally, axial loads formed from heat transferred to previously designed ribs, such as ribs 38*a* and 38*b* shown in FIG. 1, have been replaced by ribs 70 which do not make contact with walls 62*a*. Consequently, axially directed forces generated by thermal loading occurring in ribs 70 will have no effect on walls 62*a* or on stay bars 80.

Figure 1:
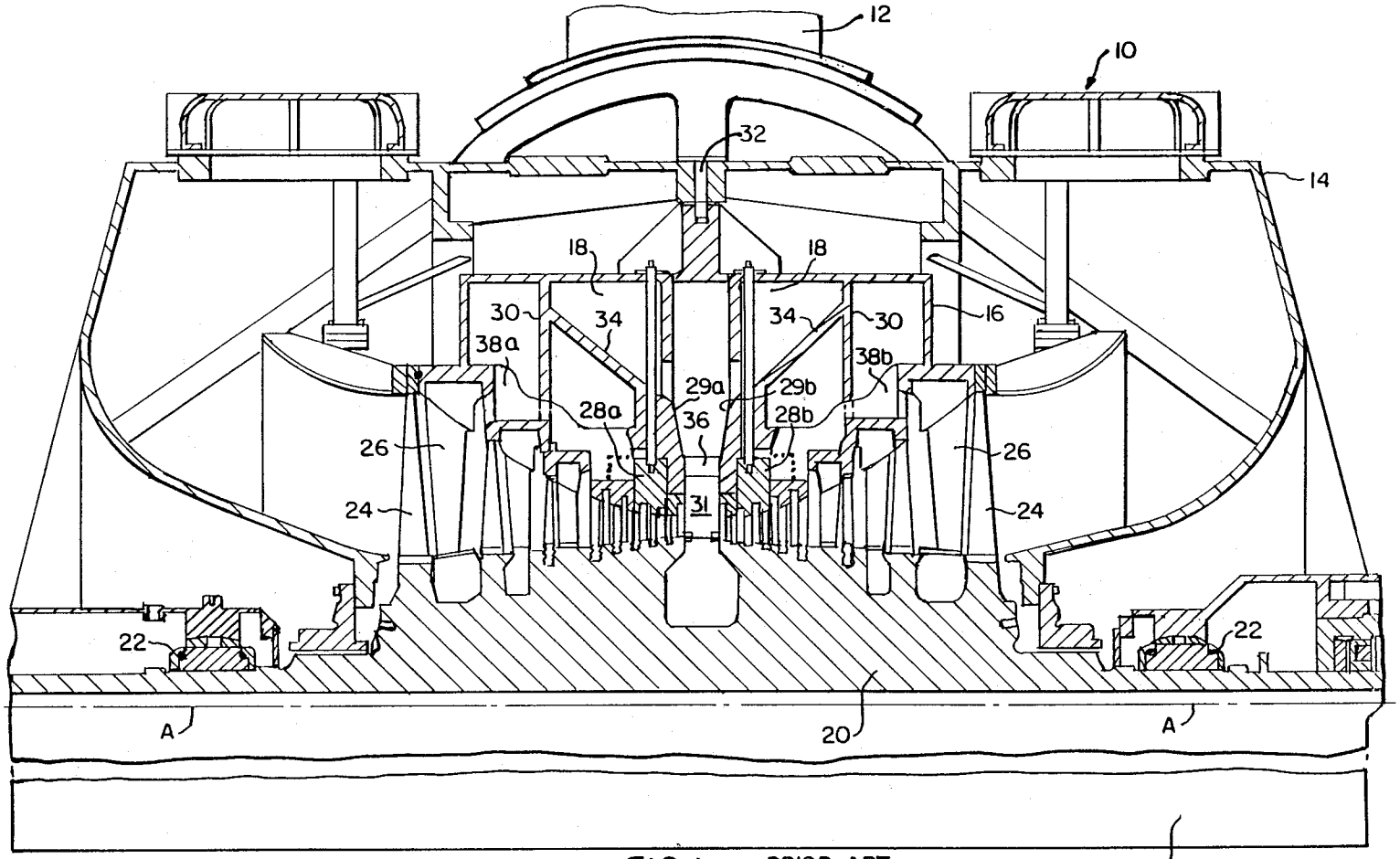
FIG. 1. PRIOR ART
FIG. 1 is a partial section view of a low pressure steam turbine having components which were utilized previously.
Figure 5:
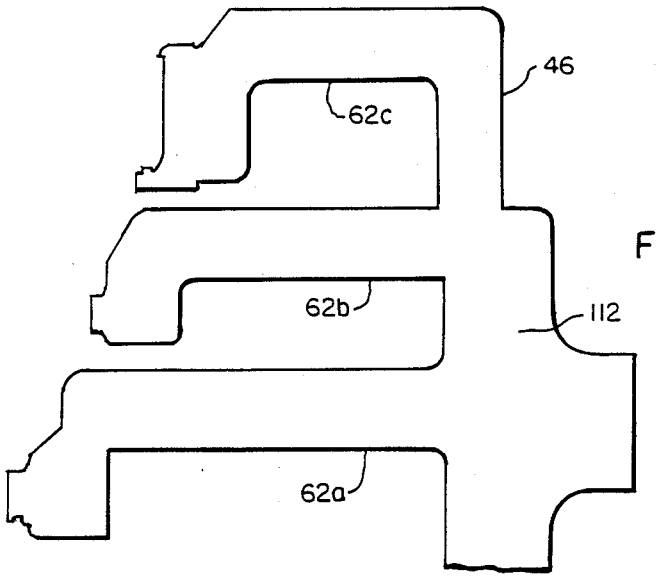
FIG. 5 is a section view along the line 5—5 in FIG. 4 isolating the horizontal joint flange of the inner casing.

A further benefit of the semi-isolation of inlet chamber 48 from ribs 70 and of providing inner casing sidewalls which are oriented perpendicular to the axis of rotation is the added flexibility to the inner casing horizontal joint flange. The horizontal joint flange of the turbine shown in FIG. 1 is relatively inflexible, due primarily to the design of ribs 29*a* and 29*b*, such that forces generated by heat transfer to inner casing 16 are more likely to result in plastic deformation of the flange. The horizontal joint flange 112, shown in FIG. 5, is more flexible due to the spacing of ribs 70 from sidewalls 62*a* and blade rings 60*a*. This added flexibility of the horizontal joint flange offers a significant reduction in the magnitude of ovalized deformation.

The flexibility of the horizontal joint flange is also enhanced by the angular positioning of ribs 70 and stay bars 80. As shown in FIG. 4, no rib or stay bar is positioned or formed along the horizontal joint flange, but rather, such components are rotated or angularly spaced from the flange.

If the flexibility of the horizontal joint flange becomes too great as a result of walls 62*b* and 62*c* no longer being connected to the inlet chamber by ribs, it may be desirable to position a stiffening gusset 114 between walls 62*b* and 62*c* as shown in FIG. 3. Although only one gusset 114 is shown, it should be understood that such a gusset would be added to both sets of walls 62*b* and 62*c*.

While the invention has been described and illustrated with reference to specific embodiments, those skilled in the art will recognize that modification and variations may be made without departing from the principles of the invention as described herein above and set forth in the following claims.

What is claimed is:

1. Apparatus for reducing thermal forces caused by thermally created loads in a low pressure steam turbine, which forces are directed parallel to the axis of rotation of a rotor, said rotor being disposed within said turbine and having annular rows of blades disposed about its periphery, comprising:

a stator assembly, positioned within a casing and about said rotor, said casing having an inlet for directing a flow of steam, said inlet being defined by sidewalls, said stator assembly having first blade rings connected to said side walls and having a stationary annular row of blades connected to each of said blade rings and operatively positioned in relation to said rotor blades for directing said flow of steam onto said rotor blades and a number of ribs disposed within said stator assembly about said rotor, wherein the ends of said ribs are spaced away from said sidewalls and said first blade rings, said stator assembly also having a horizontal joint flange wherein said ribs are angularly spaced from said horizontal joint flange.

2. The steam turbine of claim 1, further comprising additional blade rings connected to said casing and further stationary annular rows of blades connected to said additional blade rings, and reinforcing means connected to said stator assembly for prevention the axial deflection of said further stationary rows of blades.

3. The steam turbine of claim 2, wherein said casing includes first and second walls, wherein said further blade rings are connected to said first and second walls, and wherein said reinforcing means comprises a gusset positioned between and connected to said first and second walls.

4. The steam turbine of claim 2, wherein a gap exists between said first blade rings and said further blade rings further comprising sealing means positioned between said first and said further blade rings for preventing steam from passing therethrough.

5. Apparatus for reducing thermal forces caused by thermally created loads in a low pressure steam turbine, which forces are directed parallel to the axis of rotation of a rotor, said rotor being disposed within said turbine and having annular rows of blades disposed about its periphery, comprising:

an inner casing, connected about said rotor having an inlet for directing said flow of steam, said inlet having sidewalls disposed substantially perpendicular to said axis of rotation so that thermally created loads caused by heat transferred from a flow of steam to said sidewalls are directed primarily perpendicular to said axis of rotation; and a stator assembly, positioned about said rotor within said casing, having an inlet for directing a flow of steam, said inlet being defined by first blade rings connected to said sidewalls and having a stationary annular row of blades connected to each of said blade rings and operatively positioned in relation to said rotor blades for directing said flow of steam onto said rotor blades and a number of ribs disposed within said stator assembly about said rotor, wherein the ends of said ribs are spaced away from said sidewalls and said first blade rings, said stator assembly also having a horizontal joint flange wherein said ribs are angularly spaced from said horizontal joint flange.

6. A steam turbine, comprising:

a rotor having a longitudinal axis of rotation and having an annular row of blades disposed about its periphery;

a casing, connected about said rotor, said casing being divided into upper and lower halves, and said casing having an inlet directing said flow of steam, said inlet having sidewalls disposed substantially perpendicular to said axis of rotation; and a stator assembly, positioned about said rotor, having an inlet for directing a flow of steam, said inlet being defined by first blade rings connected to said sidewalls and having a stationary annular row of blades connected to each of said blade rings and operatively positioned in relation to said rotor blades for directing said flow of steam onto said rotor blades and a number of ribs disposed within said stator assembly about said rotor, wherein the ends of said ribs are spaced away from said sidewalls and said first blade rings, said stator assembly also having a horizontal joint flange wherein said ribs are angularly spaced from said horizontal joint flange.

7. The apparatus of claim 6, further comprising an outer casing, positioned about said casing and said rotor, said outer casing being divided into upper and lower halves and having an opening for allowing fluid communication with said inlet for receiving a flow of steam and outlet means for exhausting said flow of steam.

8. The apparatus of claim 6, wherein said inner casing is divided into upper and lower casing halves which are joined together along said horizontal joint flange, said joint flange being parallel to said axis of rotation.

9. A turbine for use in conjunction with a heated fluid, comprising:

a rotor having a longitudinal axis of rotation and having an annular row of blades disposed about its periphery;

an outer casing, positioned about said rotor, said outer casing being divided into upper and lower halves and having an opening for the passage of said heated fluid and outlet means for exhausting said fluid;

an inner casing, connected within and to said outer casing and about said rotor, said inner casing being divided into upper and lower halves, joined together along a joint flange, said joint flange being parallel to said axis of rotation, and said inner casing having inlet means for directing heated fluid, said second inlet means having sidewalls disposed substantially perpendicular to said axis of rotation; and a stator assembly, positioned about said rotor having an inlet for directing a flow of steam, said inlet being defined by first blade rings connected to said side walls and having a stationary annular row of blades connected to each of said blade rings and operatively positioned in relation to said rotor blades for directing said flow of steam onto said rotor blades and a number of ribs disposed within said stator asembly about said rotor, wherein the ends of said ribs are spaced away from said sidewalls, said stator assembly also having a horizontal joint flange wherein said ribs are angularly spaced from said horizontal joint flange.

10. A steam turbine, comprising:

a rotor having a longitudinal axis of rotation and having an annular row of blades disposed about its periphery;

an outer casing, positioned about said rotor, said outer casing being divided into upper and lower halves and having first inlet means for receiving a flow of steam and outlet means for exhausting said flow of steam;

an inner casing, connected within and to said outer casing and about said rotor, said inner casing being divided into upper and lower halves, joined together along a joint flange, said joint flange being parallel to said axis of rotation, and said inner casing having second inlet means in fluid communication with said first inlet means for directing said flow of steam, said second inlet means having sidewalls disposed substantially perpendicular to said axis of rotation; and a stator assembly, positioned about said rotor, having an inlet for directing a flow of steam, first blade rings connected to said side walls and having a stationary annular row of blades connected to each of said blade rings and operatively positioned in relation to said rotor blades for directing said flow of steam onto said rotor blades and a number of ribs disposed within said stator assembly about said rotor, wherein the ends of said ribs are spaced away from said sidewalls and said first blade rings, said stator assembly also having a horizontal joint flange wherein said ribs are angularly spaced from said horizontal joint flange.

11. The apparatus of claim 10, wherein said steam is provided to said steam turbine through a conduit having a first diameter and further comprising transition means for establishing fluid communication between said conduit and said second inlet means.

12. The apparatus of claim 11, wherein said transition means comprises a conduit having first and second ends, wherein said first end is generally circular and said second end is generally rectangular.

13. The apparatus of claim 12, wherein said first end has an opening having a second diameter equal to said first diameter, and said second end being connected to said second inlet means.

14. In a low pressure steam turbine wherein heat is transferred between a flow of steam provided to said turbine and the structure of said steam turbine, apparatus for reducing thermal deformation caused by thermally created loads, comprising:

a rotor having annular rows of blades disposed about the periphery of said rotor with said rows being axially spaced on either side of a rotor midpoint, said blades in each of said rows being of substantially uniform blade length, said rotor having an axis of rotation;

an inner casing, connected about said rotor, said inner casing being divided into upper and lower halves, and having an inlet for directing said flow of steam to said rotor midpoint, said inlet having sidewalls disposed substantially perpendicular to said axis of rotation so that thermally created loads caused by heat transferred from said flow of steam to said sidewalls are directed primarily perpendicular to said axis of rotation; and a stator assembly, positioned about said rotor, having first blade rings connected to said sidewalls and having a stationary annular row of blades connected to each of said blade rings and operatively positioned in relation to said rotor blades for directing said flow of steam onto said rotor blades and a number of ribs disposed within said stator assembly about said rotor, wherein the ends of said ribs are spaced away from said sidewalls and said first blade rings, said stator assembly also having a horizontal joint flange wherein said ribs are angularly spaced from said horizontal joint flange.

15. The steam turbine of claim 14, further comprising a plurality of stay bars connected between said first blade rings, wherein said stay bars are angularly spaced from said horizontal joint flange.

16. The steam turbine of claim 15, wherein said blade length increases for each row the further said row is disposed from said rotor midpoint.

17. The steam turbine of claim 16, wherein the length of each blade in each of said stationary annular rows of blades is substantially uniform and wherein said length of said stationary blades increases for each row the further said row is disposed from said rotor midpoint.

18. Apparatus for reducing thermal forces caused by thermally created loads in a low pressure steam turbine, which forces are directed parallel to the axis of rotation of a rotor, said rotor being disposed within said turbine and having annular rows of blades disposed about its periphery, comprising:

a stator assembly, positioned within a casing an about said rotor, said casing having an inlet for directing a flow of steam, said inlet being defined by sidewalls, said stator assembly having first blade rings connected to said side walls and having a stationary annular row of blades connected to each of said blade rings and operatively positioned in relation to said rotor blades for directing said flow of steam onto said rotor blades and a number of ribs disposed within said stator assembly about said rotor, wherein the ends of said ribs are spaced away from said sidewalls and said first blade rings, additional blade rings connected to said casing and further stationary annular rows of blades connected to said additional blade rings, reinforcing means connected to said stator assembly for preventing the axial deflection of said further stationary rows of blades wherein a gap exists between said first blade rings and said further blade rings and sealing means positioned between said first and said further blade rings for preventing steam from passing through said gap.

* * * * *